US005823321A

United States Patent [19]

Leclerc

[11] Patent Number: 5,823,321

[45] Date of Patent: Oct. 20, 1998

[54] LOCKING DEVICE FOR UNIPOLAR BREAKER

[76] Inventor: Michel Leclerc, 4919 route Marie-Victorin, St-Antoine-de-Tilly, Qc, Canada, G0S 2C0

[21] Appl. No.: 783,544

[22] Filed: Jan. 14, 1997

[30] Foreign Application Priority Data

Jan. 15, 1996 [CA] Canada ..... 2166960

[51] Int. Cl.[6] ..... H01H 9/28

[52] U.S. Cl. ..... 200/43.19; 200/43.16; 200/43.01

[58] Field of Search ..... 200/43.04, 43.01, 200/43.02, 43.16, 43.19, 43.21, 48 R, 49

[56] References Cited

U.S. PATENT DOCUMENTS

| | | | |
|---|---|---|---|
| 1,712,856 | 5/1929 | Thullen | 200/43.16 |
| 1,981,353 | 11/1934 | Getchell | 200/43.16 |
| 5,319,618 | 6/1994 | Hutko | 200/331 |

FOREIGN PATENT DOCUMENTS

| | | | |
|---|---|---|---|
| 535662 | 1/1957 | Canada | 200/318 |
| 573737 | 11/1923 | France | 200/48 |
| 244385 | 1/1925 | Italy | 200/169 |

*Primary Examiner*—David J. Walczak

[57] ABSTRACT

A locking device for unipolar breaker is remote-controlled: the device surrounds a breaker blade and adds to a pivoting-base of the blade a T-shaped piece which prevents the closing of the blade. The T-shaped piece comprises a wide web and two wedge points. The wide web is of a reversed U-shape comprising wings that are locked together by a latch placed inside one of the wings and operated by a key. The latch cannot be triggered too easily so it will not start by itself. To trigger the latch, a key has to be inserted into a casing located in a wing. This casing holds a disk with scarf-joints while the key has a disk with grooves, the combination of scarf-joints and grooves allowing various combinations. The key is located at the end of a gaff, so that only one user may lock or unlock the switch.

8 Claims, 9 Drawing Sheets

LOCKING DEVICE FOR UNIPOLAR BREAKER

BACKGROUND FIELD OF THE INVENTION

This invention belongs to the family of safety devices to lock a unipolar line breaker especially to lock one breaker blade from a remote wedge point and allow only a technician that has locked it to unlock it. This invention relates to the safety of people working on high voltage lines.

BACKGROUND DESCRIPTION OF THE PRIOR ART

FR 573,737, Gardy, 23 Nov. 1923 shows a movable cartridge maneuverable with a gaff but it does not have any breaker locking means not any way to stop current without a cartridge.

IT 244,385, Gardy, 25 Nov. 1925 illustrates a blocking mechanism with a spring 25, a wedge point 29 and a support 5. The breaker is on the installation itself and Gardy does not suggest any external blocking means.

CA 535,662, Crabbs, 8 Jan. 1957 shows a cylindrical plate mounted on a square frame that can be extended with an hand grip 140; a spring 136 moves a latch plunger 124 towards a recess 120. When pulling from the ground, one covers an arch about a pivot 26. When pushed, it closes. A key interlock blocks at ground level but a copy of that key will open it. Crabbs does not suggest a key with grooves, nor a combination of such keys.

U.S. Pat. No. 5,319,168, Hutko, June 1994 suggests the use of a padlock, which cannot easily be used at a distance.

OBJECTS AND ADVANTAGES

This invention has, a principal feature, to be able to remotely lock a unipolar line breaker for a given period of time. A first objective is to provide a remote unipolar line breaker lock, that joints breaker blade and provides a pivoting base of the blade with means to prevent the closing of the blade onto a receiver that would otherwise permit the passage of current through the blade. The means for the prevention of closing must permit a sufficient gap so the current will not jump from the receiver to the blade.

A second objective is to provide means to lock and unlock the locking device with a latch located in the locking device that can be triggered from a remote position. The latch mechanism should not be too easy to release so it will not be released by itself, without operator control. Access to the latch should also be possible with a gaff, from a distance of six meters and control means should be present to insure that the locking mechanism is really locked.

A third objective is to provide a disk with scarf-joints inside the locking device that coincide with a disk of a male part, placed at the end of a gaff so only one designated operator may lock and unlock the locking means. To this end, the disks have scarf-joints and grooves in various positions to allow different locking combinations for different technicians.

BRIEF DESCRIPTION OF THE DRAWINGS

The present invention will be further understood from the following description with reference to the drawings in which.

DESCRIPTION OF THE PREFERRED EMBODIMENT

Figure 1:
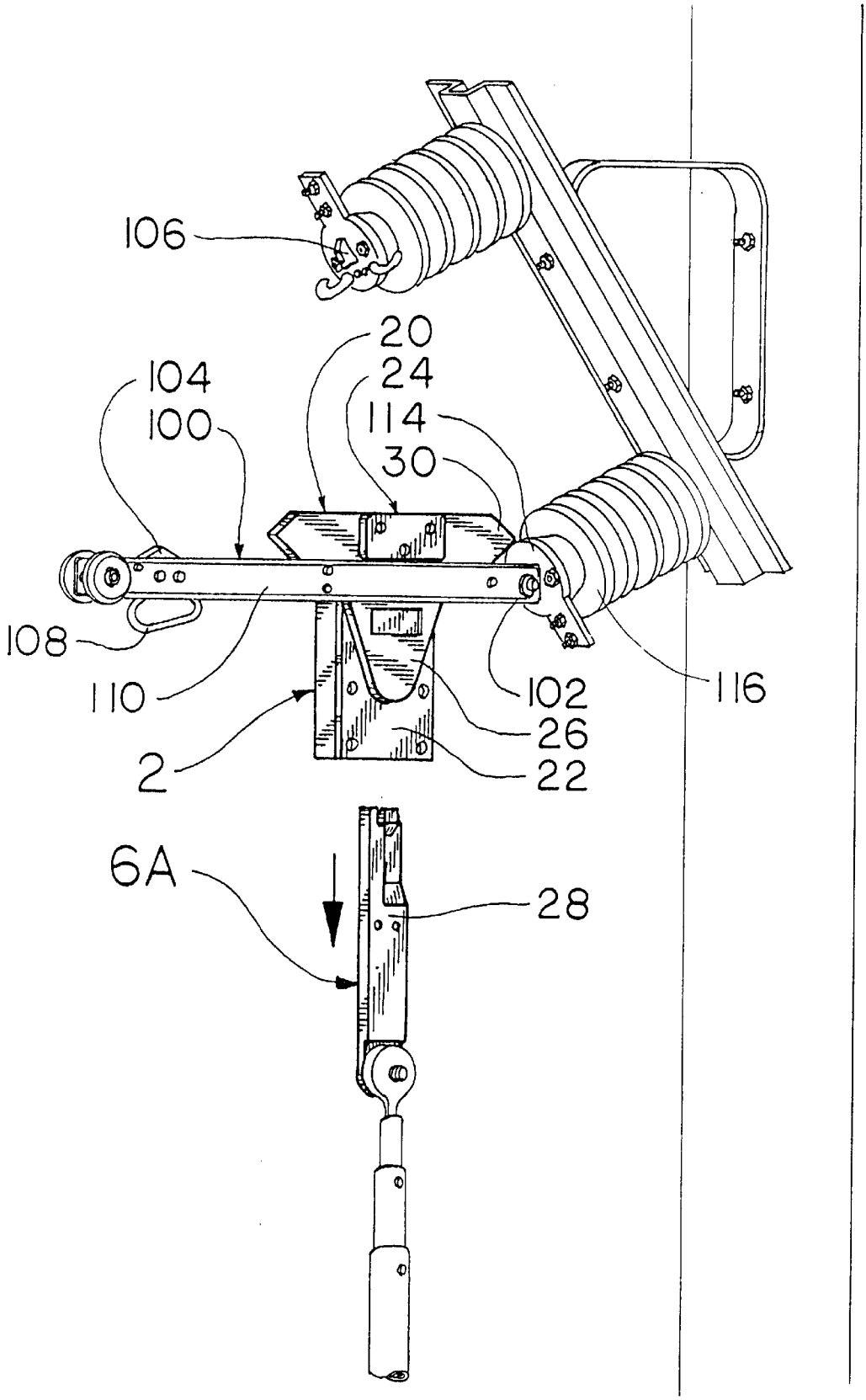
FIG. 1 is a perspective of a locking device, installed.
Figure 2:
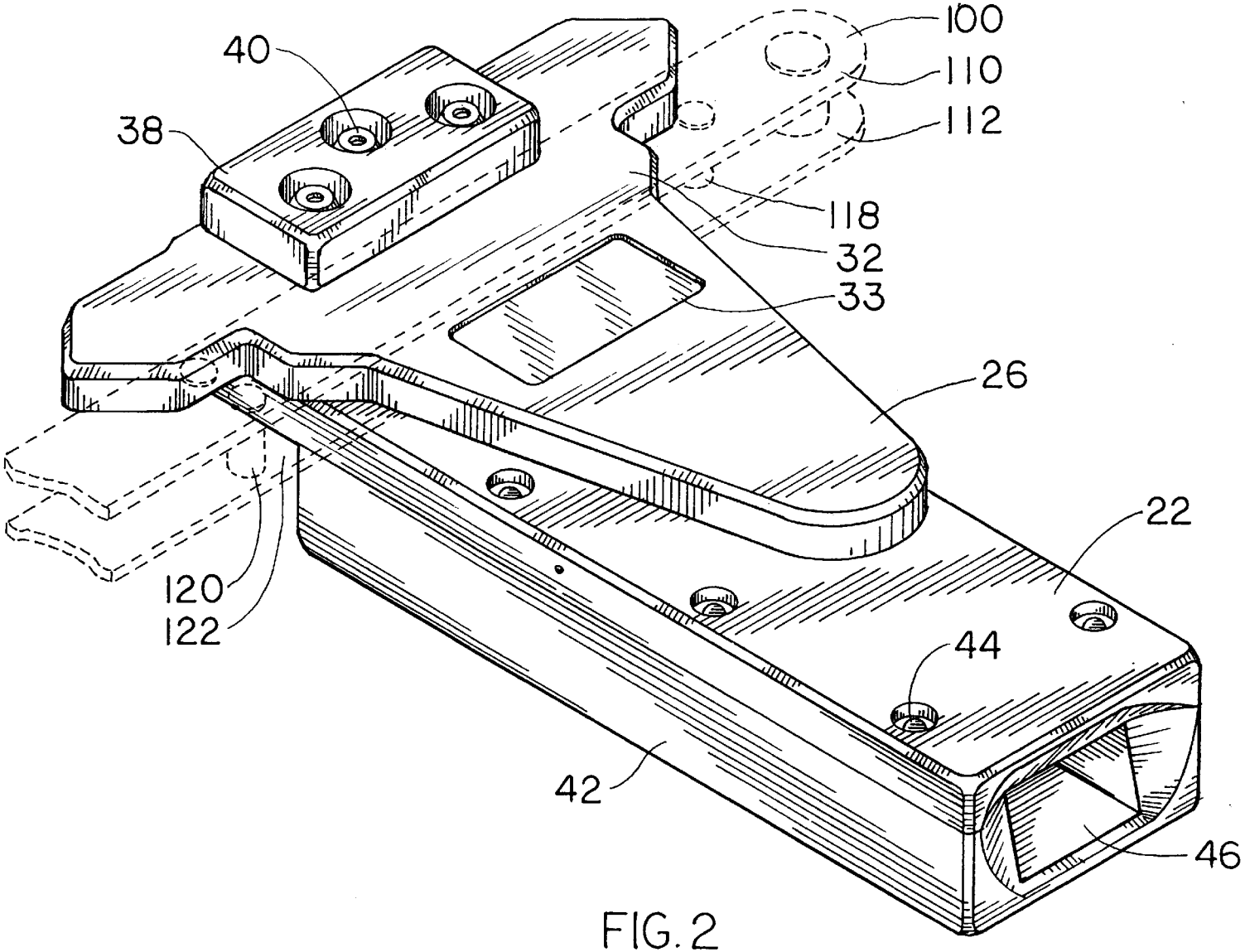
FIG. 2 is a perspective of the device with a unipolar line breaker, in dotted lines.

A preferred embodiment of the invention is illustrated in FIG. 1 where the same characterizing elements are identified by the same numbers and wherein one first sees an electrical high voltage line installation comprising a unipolar breaker 100 with a pivot 102, a contact end 104 to join a contact receiver 106. The unipolar breaker 100 comprises a hook 108, a right blade 110 and a left blade 112 (FIG. 2). The pivot 102 is supported by a terminal 114 placed on a insulating cylinder 116. A U-shaped part 20 is under the right blade 110 and comprises a carrying wing 22, a web 24 and a penetrating wing 26.

Manipulation means 28 are oriented towards the carrying wing 22. The U-shaped part 20 also comprises a wedge point 30 leaning on the terminal 114 to prevent the unipolar breaker 100 to move towards a contact receiver 106.

FIG. 2 shows the unipolar breaker 100 with its left and right blades 110 and 112, and comprising left and right rigid posts 120 and 118. A shoulder 32 forms a widening of the penetrating wing 26 so that the penetrating wing will occupy the totality of a channel 122 created by the space between the left and right blades 110 and 112 and the left and right rigid posts 120 and 118. The penetrating wing 26 also comprises a recess 33 to receive a locking latch 124 —FIG. 4A—. FIG. 3A shows the shoulder 32, the penetrating wing 26, the carrying wing 22 and a right hand wedge point 30.

Figure 3B:
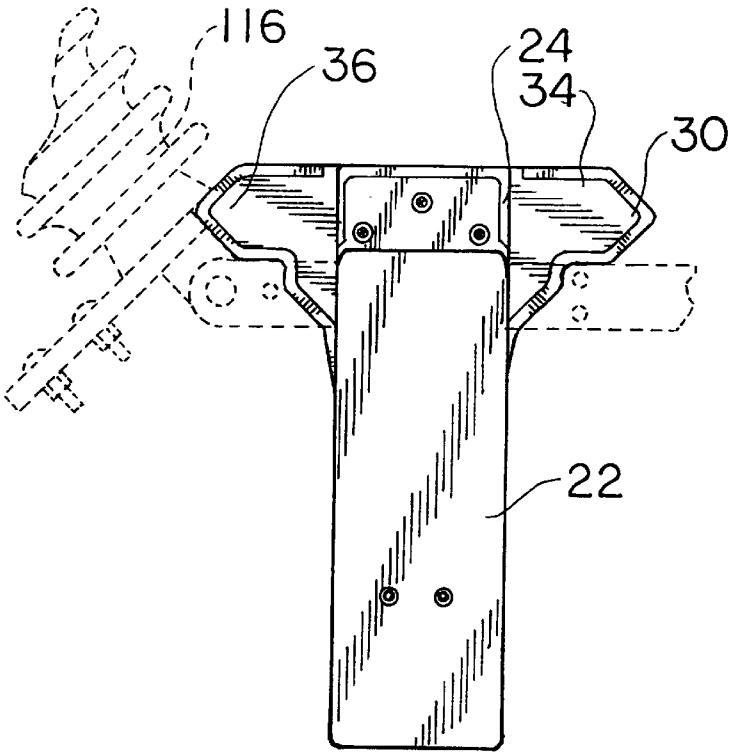
FIG. 3B is a back view of the locking device of FIG. 2.
Figure 3A:
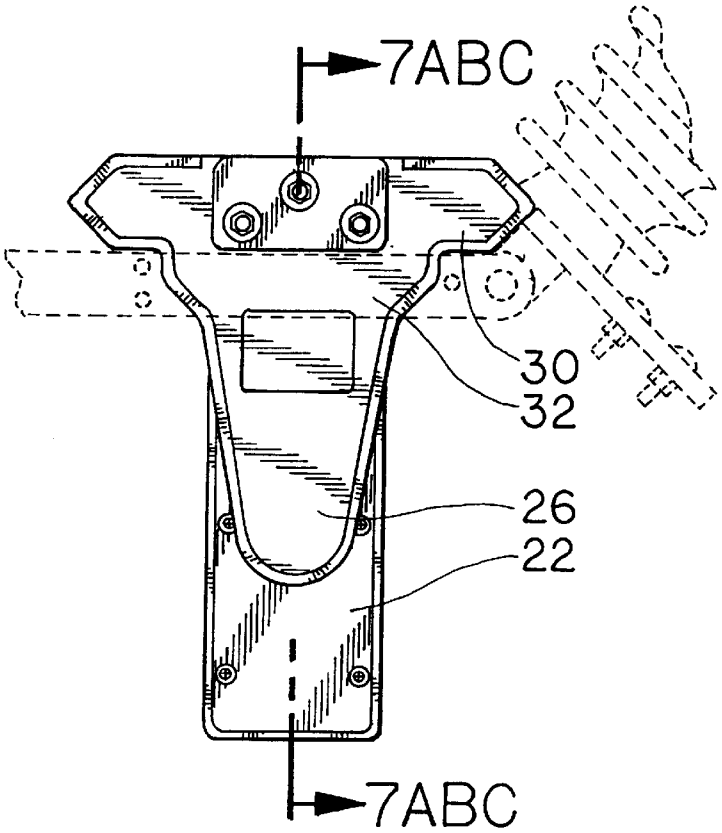
FIG. 3A is a front view of the locking device of FIG. 2.

FIG. 3B shows the carrying wing 22, the web 24 continuing with an extension 34 comprising the right hand wedge point 30 to the right and a left hand wedge point with a right angle edge 36 to the left, one wedge point leaning onto the insulating cylinder 116 to prevent the contact of the unipolar breaker with the contact receiver 106.

Figure 4B:
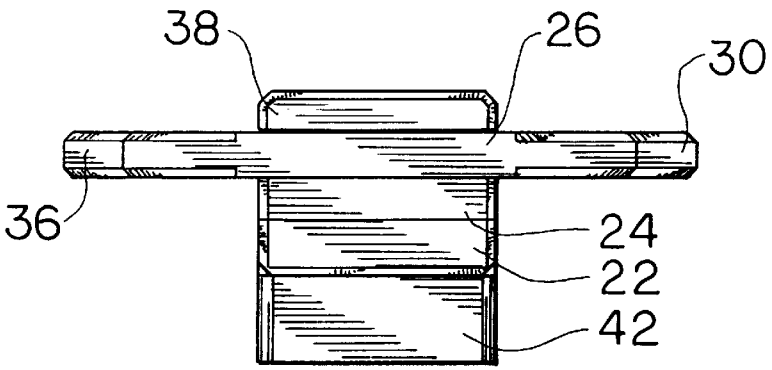
FIG. 4B is a top plan view according to line 4B—4B of FIG. 4A.
Figure 4C:
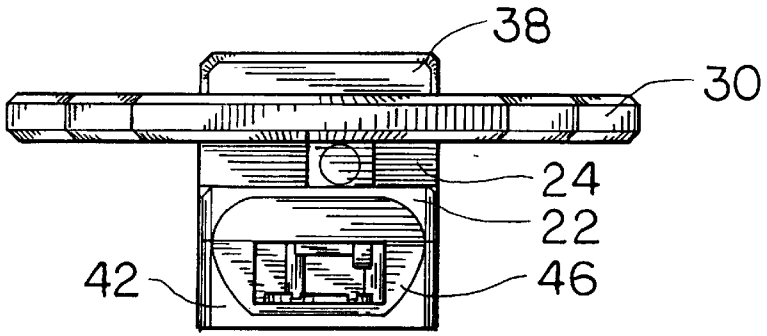
FIG. 4C is a bottom plan view according to line 4C—4C of FIG. 4A.
Figure 4A:
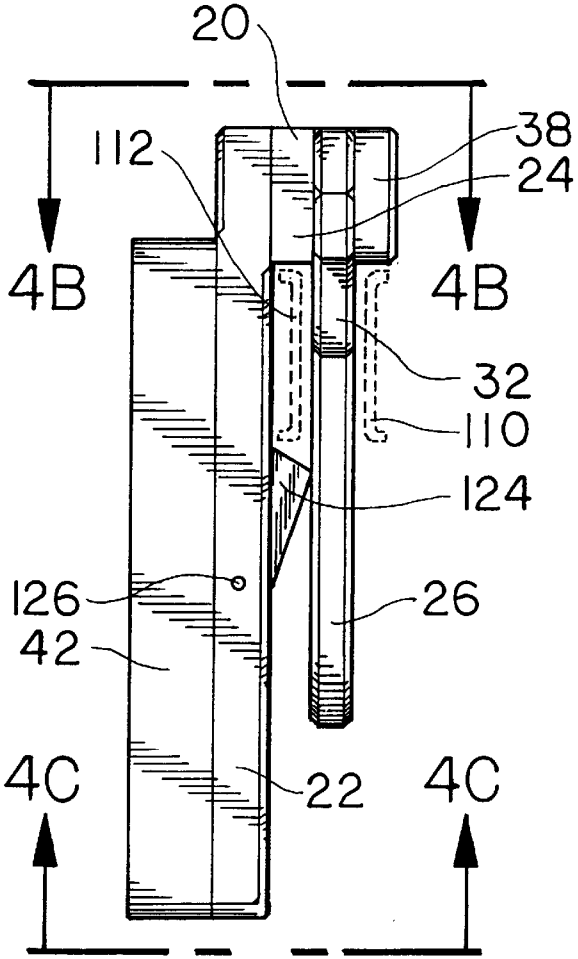
FIG. 4A is a side view of the locking device of FIG. 2.

FIG. 4A shows the right blade 110, in dotted line, the left blade 112, also in dotted line, the shoulder 32, the web 24 of the U-shaped part 20 with its carrying wing 22 and its penetrating wing 26, which abutts a holding block 38 sitting on the right blade 110. Head screws 40 (FIG. 2), in the holding block 38, hold the web 24 with the carrying wing 22 and the penetrating wing 26. A hollow body 42 is fixed to the carrying wing 22 by means of body screws 44. The hollow body 42 has an opening 46.

The latch 124 locks the left blade 112.

FIG. 4B shows the hollow body 42 fixed to the carrying wing 22, the web 24, the right end wedge point 30 and the holding block 38, all together.

FIG. 4C illustrates the opening 46 forming a funnel out of the hollow body 42 and the front of the carrying wing 22.

Figure 5A:
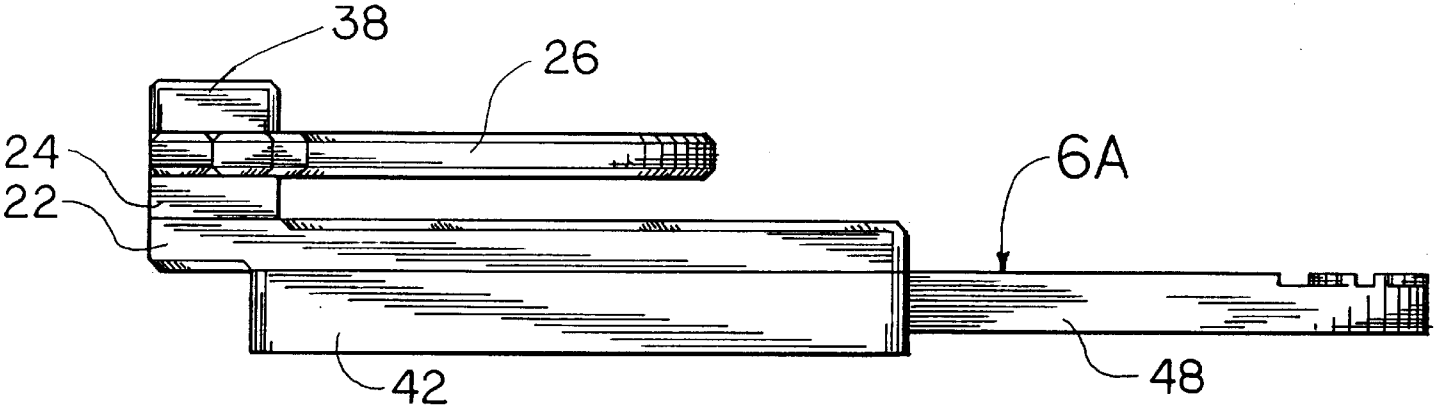
FIG. 5A is a side view with a key appearing on the right.

FIG. 5A shows the key 48 inserted into a sleeve-like interior of the hollow body 42.

Figure 5B:
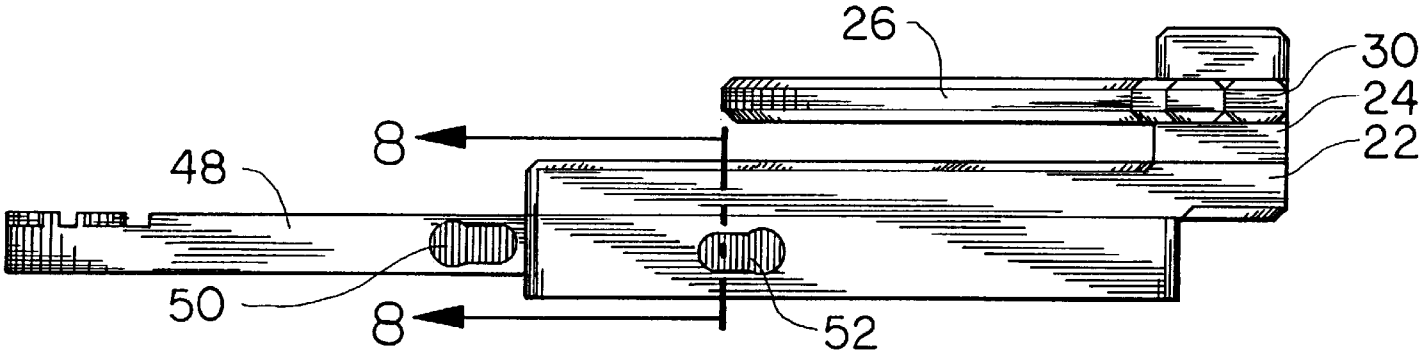
FIG. 5B is a side view with the key appearing to the left.

FIG. 5B shows the key 48, with the groove key 50 and a sleeve 52.

Figures 6A, 6B, 6C, 6D, 6E, 6F:
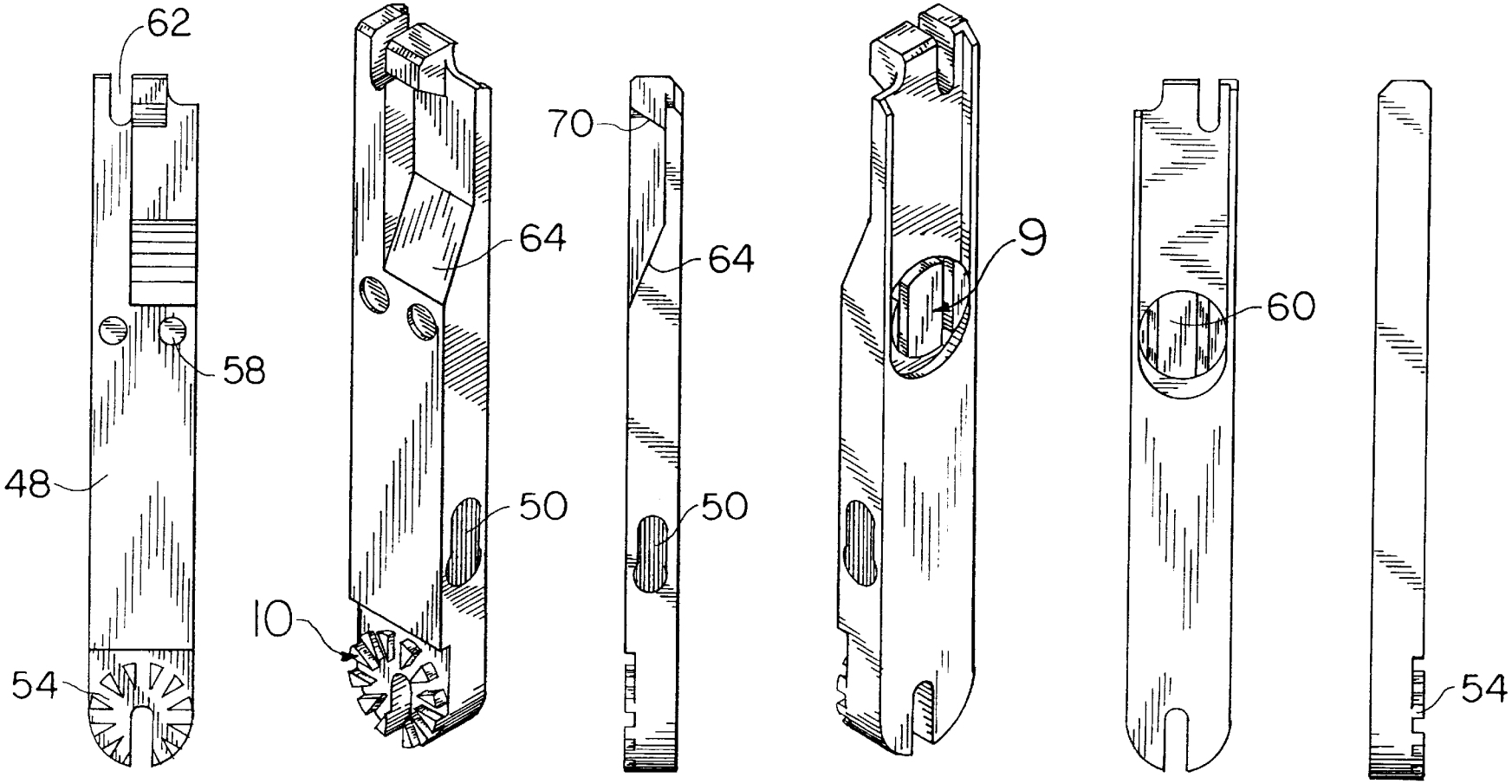
FIG. 6A is a top plan view of the key, in region 6A of FIG. 5A.
FIG. 6B is a perspective of the top side of the key of FIG. 5A.
FIG. 6C is a view of the right side of the key of FIG. 6A.
FIG. 6D is a perspective of the underside of the key of FIG. 6A.
FIG. 6E is a view of the underside of the key of FIG. 6A.
FIG. 6F is a view of the left side of the key of FIG. 6A.

FIG. 6A shows a daisy-shaped part 54 at the end of an assembly of the key 48. The eyes 58 give access to a superior disk 84 (FIG. 7C). A strengthening hole 62 serves to bypass a column.

FIG. 6B shoos an angle 64 displaced to the right and pushing onto a half-moon 66 (FIG. 7B) to turn the sliding latch 68. The groove key 50 may also be seen.

FIG. 6C illustrates the projections 70 (FIG. 7C).

FIG. 6E illustrates the circular shape of an inferior disk 60.

Figure 7A:
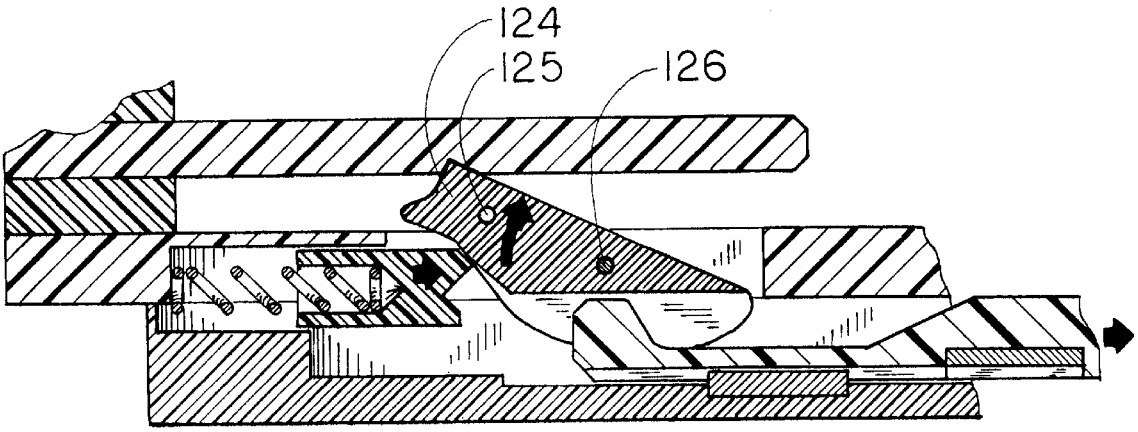
FIG. 7A is a cross section according to line 7A—7A of FIG. 3A.

FIG. 7A shows the pivot 126, locking latch 124 and also an alignment hole 125 used during the fabrication of the U-shaped part 20. The locking latch 124 is in a locking position and, according to the circular arrow, maintained in that position by a V-shaped locking piece 74 (FIG. 7B) identified by a small arrow and pushed by a spring 76 (FIG. 7B).

Figure 7B:
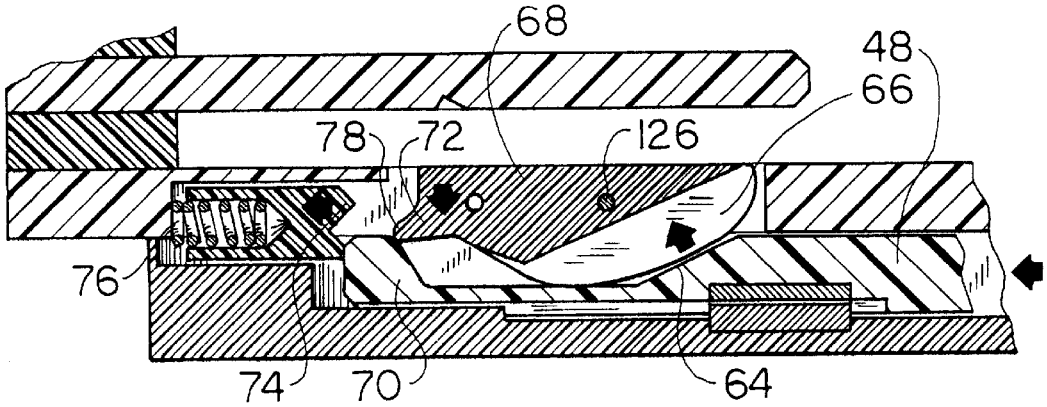
FIG. 7B is a cross section similar to FIG. 7A, position B.
Figure 7C:
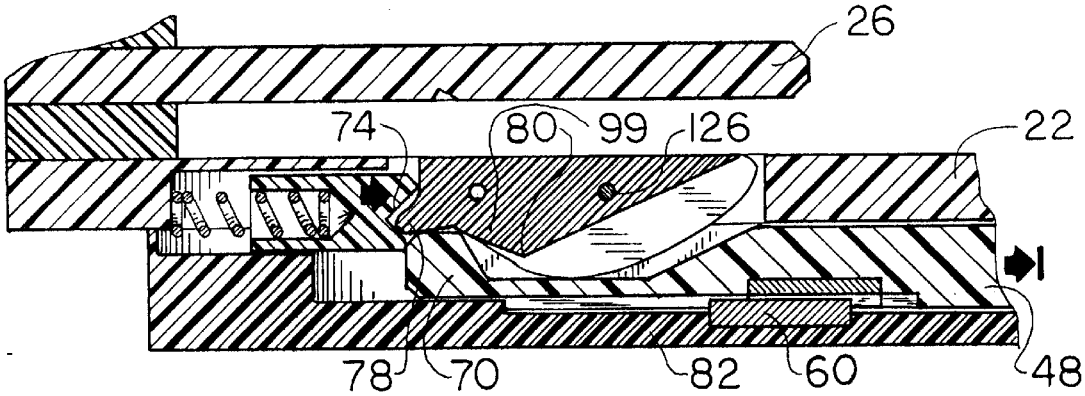
FIG. 7C is a cross sectional similar to FIG. 7A, position C.

FIG. 7B shows the pivot 126, the sliding latch 68, the key 48, the angle 64, the half-moon 66, an open part 72, the a V-shaped locking piece 74, a tip 78, a triangle 80, a casing 82 and the superior disk 84. The sliding latch 68 is in a horizontal position, thereby leaving open a channel which may permit the passing of the left blade 112 (FIG. 4A).

FIG. 7C shows a carrying wing 22 with the penetrating wing 26. An excrescence 99 has the triangle 80 which pivots around pivot 126. The tip 78 is protruding into contact with the V-shaped locking piece 74. The casing 82 receives a key 48 which passes over the superior disk 84.

Figure 8:
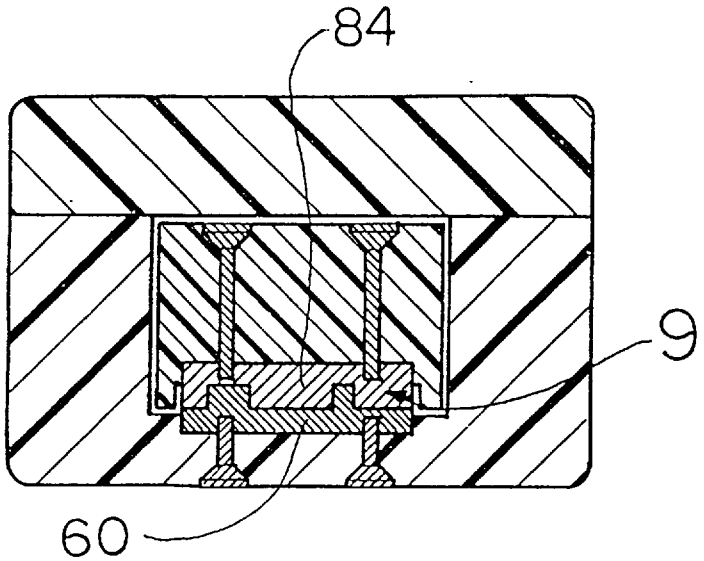
FIG. 8 is a cross section according to line 8—8 of FIG. 5B.

FIG. 8 shows the superior disk 84 and the inferior disk 60 when in mating position.

Figure 9:
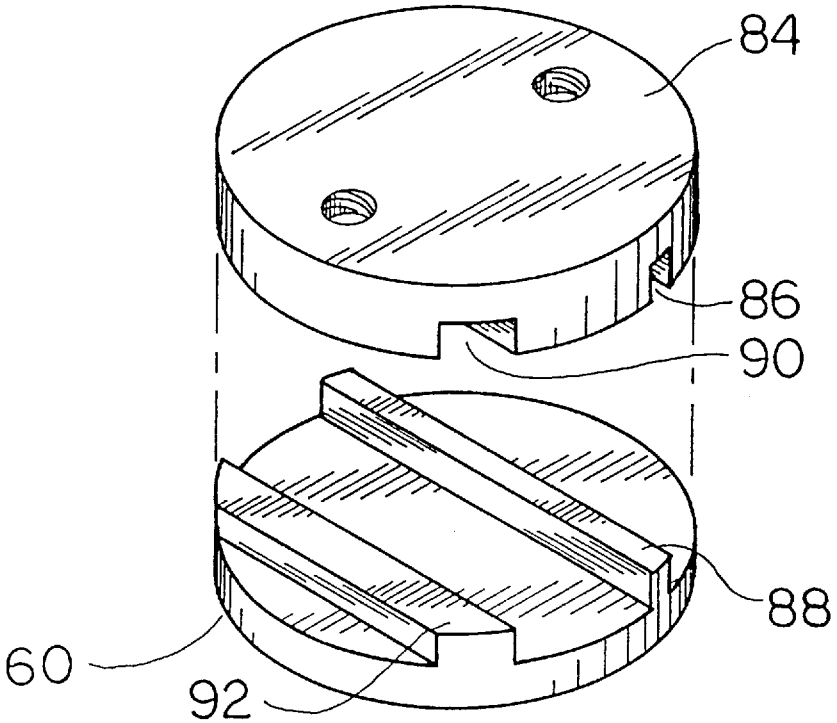
FIG. 9 is an exploded view of a medallion, arrow 9 of FIG. 6D.

FIG. 9 shows a set of two disks of which the superior disks 84 with a first groove 86 and a second groove 90, the inferior disk 60 with a first scarf-joint 88 to join with the first groove 86 and a second scarf-joint 92 to join with the second groove 90.

Figure 10:
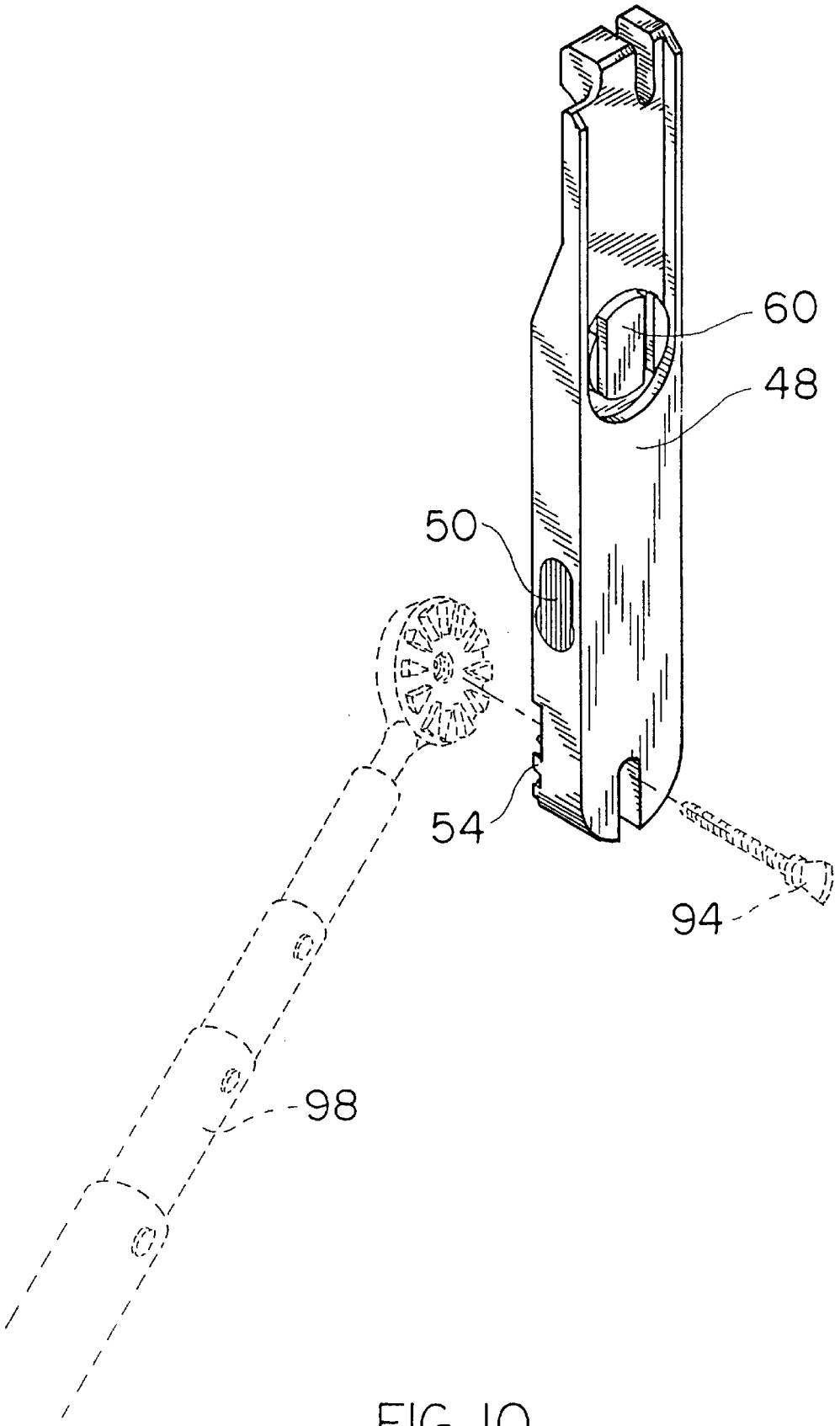
FIG. 10 shows an assembly of a key to a gaff in dotted line.

FIG. 10 shows the key 48 during the installation of the daisy-shaped part 54 with the bolt 94 facing a ruff 96, opposed to the daisy-shaped part, and supported on an extensible gaff 98 that can be about 6 meter long.

SUMMARY

This invention is a locking device for a unipolar breaker 100, that can move from an original position letting the current go through, to a safety position breaking the current, the unipolar line breaker 100 comprising two blades, a right blade 110 and a left blade 112, united by posts, a right rigid post 118 and a left rigid post 120 defining a channel 122 between the blades and the right and left rigid posts 118 and 120, the locking device comprising:

a U-shaped part 20, with a reversed U-shaped comprising a carrying wing 22, a web 24 and a penetrating wing 26.

the carrying wing 22 adapted to receive remote manipulation means 28.

the penetrating wing 26 comprising means for lateral blocking to prevent lateral displacement of the penetrating wing 26 and means for longitudinal blocking located towards the carrying wing 22 and means to prevent withdrawal of the penetrating wing 26.

the web 24 comprising an extension ending with a wedge point 30 forming a L-shaped with the penetrating wing 26, the right end wedge point 30 blocking when the unipolar breaker 100 is lowered towards the original position, thus keeping the safety position breaking the current.

The means for lateral blocking are a shoulder 32 in the channel 122 that comes in contact with the left 112 and right 110 blades and the right 118 and left 120 rigid post, the extension 34 projecting over the shoulder 32.

The means for longitudinal blocking are mobile on the carrying wing and move around a pivot 126, from a position of a locking latch 124, blocking the left blade 112 to prevent the left blade 112 to come off of the U-shaped part 20 and a position of sliding latch 68 so the U-shaped part 20 may slide freely around the left blade 112.

The position of sliding latch 68 is caused by the key 48 inserted into the casing 82 which has an opening of a size corresponding to the thickness of the key. The key is installed parallel to the carrying wing 22 and the casing 82 extends beyond the pivot 126. The key 48 has a shoulder at an angle 64 used as a cam surface to push (FIG. 7B) a half-moon 66 counterclockwise about the pivot 126 to tip an open part 72, until its tip 78 gets access to the V-shaped locking piece 74.

The casing comprises the V-shaped locking piece 74 protruding on a spring 76; the key 48 has a projection 70 to push the V-shaped locking piece 74 against the spring 76.

the V-shaped locking piece 74 receives the tip 78 mounted on the latch when the projection 70 is withdrawn, thus allowing the insertion of the U-shaped part 20 between the left 112 and the right 110 blades.

The projection 70 comprises a sloping retraction triangle 80, the sliding latch 68 comprising an excrescence 99 facing the triangle 80, the retreat of the projection 70 pushing on the excrescence 99 through the triangle 80 thus causing the tip 78 to come clockwise out of the V-shaped locking piece 74. The displacement around the pivot 126 causes the positioning of the locking latch 124 in a locking position. Referring to FIG. 4A one sees that the left blade 112 is now caught between the web 24 and the locking latch 124 and even if accidentally one might try to bring forward contact end 104 (FIG. 1) onto contact receiver 106, the wedge point 30 pushing onto terminal 114 would maintain right blade 110 away from proximity to contact receiver 106, especially if the penetrating wing 26 and its shoulder 32 (FIG. 2) are kept tightly held in channel 122 and against right and left rigid posts 118, 120.

The casing 82 comprises the mobile inferior disk 60 comprising the [a] first scarf-joint 88 and [wherein] the key 48 comprises a superior disk 84 with a first groove 86 to slide in the first scarf-joint 88. The first groove 86 is with a second groove 90, located at a certain distance from [of] the first groove 86 and receiving the [a] second scarf-joint 92, located at a certain distance from [of] the first scarf-joint 88, the distance varying to allow various combinations. Other embodiments are possible and limited only by the scope of the appended claims.

PARTS LIST

20 U-shaped part 76 spring
22 carrying wing 78 tip
24 web 80 triangle
26 penetrating wing 82 casing
28 manipulation means 84 superior disk
30 wedge point 86 first groove
32 shoulder 88 first scarf-joint
33 recess 90 second groove
34 extension 92 second scarf-joint
36 right angle edge 94 bolt
38 holding block 96 ruff
40 head screw 98 gaff
42 hollow body 99 excrescence
44 body screw 100 unipolar breaker
46 opening 102 pivot
48 key 104 contact end
50 groove key 106 contact receiver
52 sleeve groove 108 hook
54 daisy-shaped part 110 right blade
58 eye 112 left blade
60 inferior disk 114 terminal
62 strengthening hole 116 insulating cylinder
64 angle 118 right rigid post
66 half-moon 120 left rigid post
68 sliding latch 122 channel
70 projection 124 locking latch
72 open part 125 alignment hole
74 U-shaped locking piece 126 pivot
76 spring
78 tip
80 triangle
82 casing
84 superior disk
86 first groove
88 first scarf-joint
90 second groove
92 second scarf-joint
94 bolt
96 ruff
98 gaff
99 excrescence
100 unipolar breaker
102 pivot
104 contact end
106 contact receiver
108 hook
110 right blade
112 left blade
114 terminal
116 insulating cylinder
118 right rigid post
120 left rigid post
122 channel
124 locking latch
125 alignment hole
126 pivot

I claim:

1. A locking device for a unipolar line breaker (100), such as used in overhead high voltage lines, said unipolar breaker moving from an original position, letting a current go through, to a safety position, breaking said current, said unipolar breaker (100) defining a rectangular channel (122) having long sides and shorter sides, said long sides being defined by a right blade (110) and a left blade (112), said shorter sides being defined by aright rigid post (118) and a left rigid post (120), said locking device comprising:

a reversed U-shaped part (20) comprising a carrying wing (22), a web (24) and a penetrating wing (26), said penetrating wing (26) adapted for being engaged between said right blade (110) and said left blade (112) until said web (24) is resting on one if said left blade (112) or right blade (110), said carrying wing (22) having an opening (46) (FIG. 1) for receiving remote manipulation means (28), said penetrating wing (26) comprising means for lateral blocking to prevent lateral displacement within said rectangular channel (122) and said carrying was comprising means for longitudinal blocking to prevent longitudinal displacement within said channel and (22) for preventing withdrawal of said penetrating wing (26), said web (24) comprising an extension (34) ending with a wedge point (30) forming an L-shape with said penetrating wing (26), said wedge point (30) blocking movement of said unipolar breaker when said unipolar breaker (100) is lowered towards said original position, thus keeping said safety position, thereby breaking said current.

2. The device of claim 1 wherein said means for lateral blocking comprise a shoulder (32) large enough for fitting said rectangular channel (122) by coming into close contact with said left (112) and right (110) blades and said right (118) and left (120) rigid posts, said extension (34) projecting as said L-shaped from said shoulder (32) for resting against said left or right rigid post (118).

3. The device of claim 1 wherein said means for longitudinal blocking is a locking latch (124) mobile on said carrying wing (22) and moving around a pivot (126) on said carrying wing (22), from a position blocking said left blade (112) and preventing said left blade (112) from releasing from said U-shaped part (20), to a position of a sliding latch (68), when said U-shaped part (20) slides freely over said left blade (112).

4. The device of claim 3 wherein said position of a sliding latch (68) (FIG. 7B) is caused by a key (48) inserted into said opening (46), to funnel into a casing (82) of a corresponding size as said key (48) and installed parallel to said carrying wing (22), said casing (82) extending to the rear of said pivot (126), said key (48) comprising an angle (64) acting as a cam surface for pushing a half-moon (66) around said pivot (126) to tip an open part (72), thus freeing an access for said left blade (112).

5. The device of claim 4 wherein said casing (82) comprises a V-shaped locking piece (74) protruding on a spring (76), said key (48) comprising a projection (70) to push said V-shaped locking piece (74) against said spring (76), said V-shaped locking piece (74) to receive a tip (78) mounted on said latch when said projection (70) has withdrawn, thus allowing the insertion of said U-shaped part (20) between said left (112) and right (110) blades.

6. The device of claim 5 wherein said projection (70) contacts a sloping retraction triangle (80), said sliding latch (68) comprising an excrescence (99) facing said triangle (80), the retreat of said projection (70) pushing on said excrescence (99) through said triangle (80) thus causing said tip (78) to come out of said V-shaped locking piece (74) and move around said pivot (126) causing positioning of said locking latch (124) in a locking position.

7. The device of claim 4 wherein said casing (82) comprises an inferior disk (60) (FIG. 9) comprising a first scarf-joint (88) and wherein said key (48) comprises a superior disk (84) with a first groove (97) to slide in said first scarf-joint (88).

8. The device of claim 7 wherein said first groove (86) is paired with a second groove (90) located a certain distance from said first groove (86) and receiving a second scarf-joint (92), located at said certain distance form said first scarf-joint (88).

* * * * *